US008193992B2

(12) United States Patent
Ikonen

(10) Patent No.: US 8,193,992 B2
(45) Date of Patent: Jun. 5, 2012

(54) RADIO COMMUNICATION APPARATUS AND AN ASSOCIATED METHOD

(75) Inventor: Pekka Martti Tapio Ikonen, Helsinki (FI)

(73) Assignee: Nokia Corporation, Espoo (FI)

( * ) Notice: Subject to any disclaimer, the term of this patent is extended or adjusted under 35 U.S.C. 154(b) by 1048 days.

(21) Appl. No.: 11/998,696

(22) Filed: Nov. 30, 2007

(65) Prior Publication Data

US 2009/0140945 A1 Jun. 4, 2009

(51) Int. Cl.
*H01Q 1/24* (2006.01)

(52) U.S. Cl. ..... 343/702; 343/787; 343/700 MS

(58) Field of Classification Search ..... 343/787, 343/793, 795, 700 MS, 702
See application file for complete search history.

(56) References Cited

U.S. PATENT DOCUMENTS

| | | | | |
|---|---|---|---|---|
| 2005/0270237 | A1* | 12/2005 | Iguchi et al. | 343/702 |
| 2007/0097008 | A1* | 5/2007 | Chen | 343/795 |
| 2007/0273600 | A1* | 11/2007 | Tsujimura et al. | 343/787 |

FOREIGN PATENT DOCUMENTS

JP 2000101338 12/2001

OTHER PUBLICATIONS

Vainikainen et al, "Resonator-based analysis of the combination of mobile handset antenna and chassis", IEEE transactions on Antennas and Propagation, vol. 50 No. 10 pp. 1433-1444, 2002.
Ikonen et al, "Magnetodielectric substrates in antenna miniaturization: Potential and limitations", IEEE transactions on antennas and propagation, vol. 54 No. 11, pp. 3991-3999, 2006.
Wang et al, "Effects of ferrite sheet attachment to portable telephone in reducing electromagnetic absorption in human head", IEEE International symposium on electromagnetic compatibility, vol. 2 pp. 822-825, 1999.

* cited by examiner

*Primary Examiner* — Dieu H Duong
(74) *Attorney, Agent, or Firm* — Harrington & Smith

(57) ABSTRACT

An apparatus including: a conductive antenna; a conductive object; a connection having a complex electrical impedance between the antenna and the conductive object; and an element having a complex magnetic permeability located adjacent the conductive antenna, wherein, when the conductive antenna is energized, the connection and the element substantially reduce a phase difference between an electric current flowing in the conductive antenna and an induced electric current flowing in the conductive object. Methods and other apparatus are described and claimed.

31 Claims, 3 Drawing Sheets

RADIO COMMUNICATION APPARATUS AND AN ASSOCIATED METHOD

FIELD OF THE INVENTION

Embodiments of the present invention relate to improving a radio communication apparatus. In particular, they address a problem that may arise when a conductive object is located close to an antenna.

BACKGROUND TO THE INVENTION

There is a current trend towards increasing "functionality per unit volume" for electronic devices. This may mean that devices retain substantially the same functions but they are miniaturized or that additional functions and components are packed into the same volume.

In the field of radio communications it is important to have an antenna that has a bandwidth that covers a desired frequency band and that has an input impedance that enables efficient operation. A problem can arise when conductive objects are brought close to or closer to the antenna as they interfere with its operation.

It is therefore not a simple matter to increase the functionality per unit volume for a radio communications apparatus as it may result in a conductive object being brought close or closer to the antenna and cause a degradation in performance.

BRIEF DESCRIPTION OF VARIOUS EMBODIMENTS OF THE INVENTION

According to various embodiments of the invention there is provided an apparatus comprising: a conductive antenna; a conductive object; a connection having a complex electrical impedance between the antenna and the conductive object; and an element having a complex magnetic permeability located adjacent the conductive antenna, wherein, when the conductive antenna is energized, the connection and the element substantially reduce a phase difference between an electric current flowing in the conductive antenna and an induced electric current flowing in the conductive object.

According to various embodiments of the invention there is provided an apparatus comprising: a conductive antenna having a feed; a conductive object, a connection having a reactance between the antenna and the conductive object; and magnetic material located adjacent the conductive antenna.

The reactance may be inductive, capacitive or any combination of reactances in series or parallel. A combination of reactive components can be in any known circuit topology such as, for example, T-networks, Pi-networks, basic series or parallel networks, and other network topologies which provide frequency selective couplings between the conductive object and the conductive antenna.

According to various embodiments of the invention there is provided a method of controlling the input impedance of a conductive antenna comprising: introducing a phase difference between an electric current flowing in the conductive antenna and an induced electric current flowing in a nearby conductive object.

According to various embodiments of the invention there is provided a method of controlling the input impedance of a conductive antenna comprising: connecting a complex electrical impedance between a conductive antenna and a nearby conductive object; and locating an element having a complex magnetic permeability adjacent the conductive antenna.

According to various embodiments of the invention there is provided an apparatus comprising: a conductive antenna; a conductive object; means for providing for a complex electrical impedance between the conductive antenna and the conductive object; and means for increasing magnetic permeability adjacent the conductive antenna.

BRIEF DESCRIPTION OF THE DRAWINGS

For a better understanding of various embodiments of the present invention reference will now be made by way of example only to the accompanying drawings in which.

DETAILED DESCRIPTION OF VARIOUS EMBODIMENTS OF THE INVENTION

Figure 1:
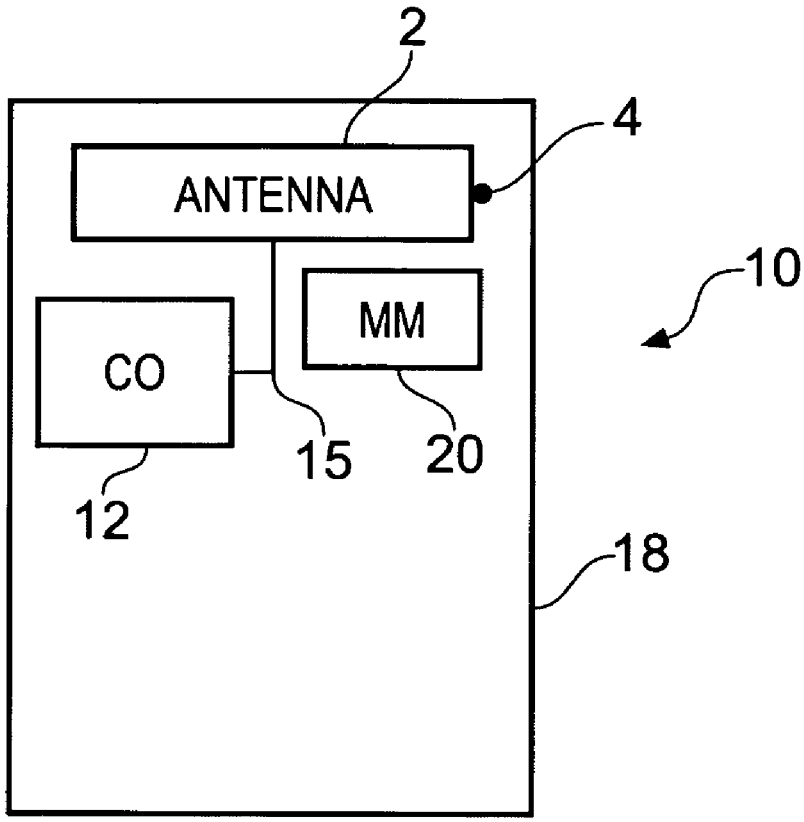
FIG. 1 schematically illustrates an apparatus.

FIG. 1 schematically illustrates an apparatus 10 comprising:

a conductive antenna 2; a conductive object 12; a connection 15 having a complex electrical impedance between the antenna and the conductive object; and an element 20 having a complex magnetic permeability located adjacent the conductive antenna 2.

The conductive antenna 2 illustrated is an internal antenna that is located wholly within a housing 18 of the apparatus 10. The antenna 2 may be a multi-part, centre fed dipole antenna having a first part, a second part and a feed positioned between and coupled to the first part and the second part.

The conductive antenna 2 may, for example, have a resonant frequency and bandwidth that covers one or more of the bands US-GSM 850 (824-894 MHz), EGSM 900 (880-960 MHz) or EU-WCDMA 900 (880-960 MHz). Alternatively other cellular bands could be covered such as PCN/DCS1800 (1710-1880 MHz); US-WCDMA1900 (1850-1990 MHz) band; WCDMA21000 band (Tx: 1920-1980 MHz Rx: 2110-2180 MHz) or PCS1900 (1850-1990 MHz).

Figure 2:
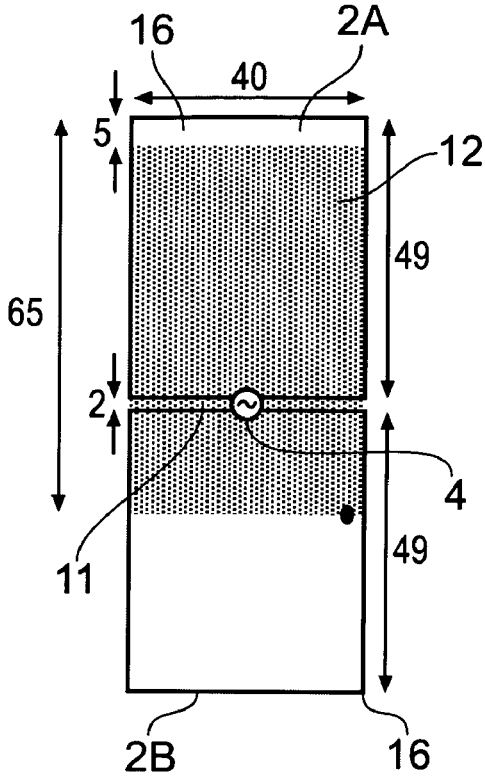
FIG. 2 illustrates in plan view a particular embodiment of the apparatus.
Figure 3:
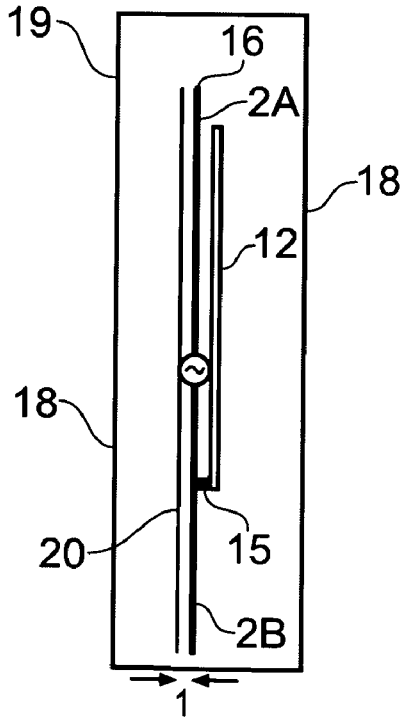
FIG. 3 illustrates in cross-sectional view the particular embodiment of the apparatus.
Figure 5:
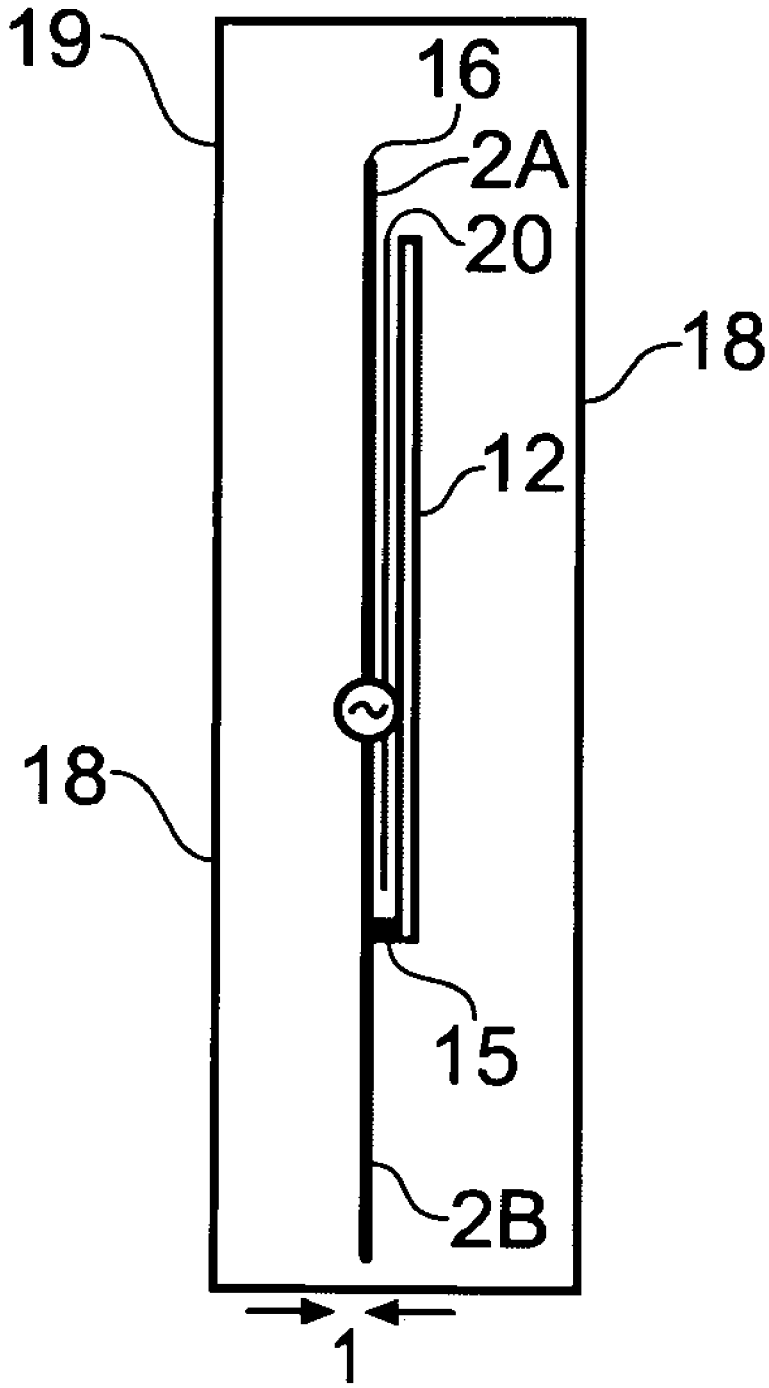
FIG. 5 illustrates in cross-sectional view the particular embodiment of the apparatus.

In the example illustrated in FIGS. 2 and 3, the antenna 2 comprises two distinct parts 2A, 2B connected to a common direct feed 4 in a dipole arrangement. The parts 2A, 2B are portions of a printed wiring board (PWB) 16, which in this example has been divided in half by gap 11.

The dimensions of the components that enable the apparatus 10 to operate in the GSM900 band are marked on the Figure in mm.

The conductive object 12 may be a component of the apparatus 10. Typically the object 12 is a component that is used for a function unconnected with radio communications. It may for example be a metallic part of a display module or a part of the housing 18.

The conductive object 12 is located adjacent to and close to the antenna 2.

In the example illustrated in FIGS. 2 and 3, the conductive object overlies the feed 4 of the antenna 2 which is a region of high H-field.

Figure 4:
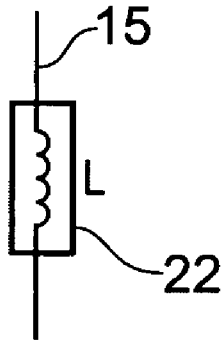
FIG. 4 illustrates one embodiment of a connection between an antenna and a conductive object.

The connection 15 between the antenna 2 and the conductive object 12 may comprise a reactance. The reactance may be inductive, capacitive or any combination of reactances in series or parallel. A combination of reactive components can be in any known circuit topology such as, for example, T-networks, Pi-networks, basic series or parallel networks, and other network topologies which provide frequency selective couplings between the conductive object and the conductive antenna element. In FIG. 4, the reactance is provided by a lumped inductor 22. In FIG. 3, the reactance is provided by a narrow shorting pin.

The connection 15 therefore has a complex electrical impedance and introduces a phase delay between the electromagnetic fields generated by the feed 4 of the antenna and the electromagnetic fields they induce in the conductive object 12. The complex part of the electrical impedance may be of the order 10Ω at 900 MHz, corresponding to an inductance of 2 nH.

The element 20 is typically a sheet of magnetic material that has a complex relative magnetic permeability with a real value and an imaginary value.

The sheet of magnetic material 20 is positioned adjacent the antenna 2 and may overlie all or substantially all of one side of the antenna 2.

The magnetic material introduces a further phase delay between the electromagnetic fields generated by the feed 4 in the antenna and the electromagnetic fields they induce in the conductive object 12.

The ratio of the real value to the imaginary value of the complex relative magnetic permeability may exceed five and/or the real value of the complex relative magnetic permeability may exceed twenty.

As an example, the relative magnetic permeability may be, at 900 MHz, approximately 30 (1-0.1 j).

As an example, the magnetic element 20 may be located, as shown in FIG. 3, between the antenna 2 and an exterior wall 19 of the housing 18 such that the antenna 2 is located between the magnetic element 20 and the conductive object 12. Alternatively, the element 20 may be located (not shown) between the antenna and the conductive object.

Other possibilities are that the magnetic material can be located between the antenna and the exterior wall of the housing, and a further example could be that the magnetic material can be both in between the antenna and the exterior wall, and in between the antenna and the conductive element. The specific implementation may be dependent on the materials chosen for the device, their location, orientation, frequency responses, and operational frequency.

When the apparatus is a hand-portable radio communication apparatus, such as a mobile cellular telephone, the exterior wall 19 of the housing may be a front face of the hand-portable radio communications device which in use may be held against a user's head.

The magnetic material may, as an example, be attached to an interior surface of the exterior wall 19 of the housing or may be a substrate for a multi-part printed wiring board 16 that is used as the antenna 2.

The magnetic material may be a ferrite or other ferromagnetic material. It may comprise iron.

The magnetic element 20 may be a laminate of magnetic layers separated by non-magnetic layers. The laminate layers may be formed by sputtering a film of iron to a depth of 0.3 microns onto a polymer substrate and then stacking the layers.

When the antenna 2 is energized, the connection 15 and the magnetic element 20 substantially reduce a phase difference between the electromagnetic fields of the antenna 2 and the electromagnetic fields induced in the conductive object 12. By adjusting or tuning the complex impedance of the connection 15, it may be possible to arrange for the electromagnetic fields of the antenna 2 and the induced electromagnetic fields in the conductive object 12 to be in phase or less out-of-phase. The reactance of the connection 15 may therefore be variable in situ by laser trimming or by using a lumped variable inductor as inductor 22.

The input impedance of an antenna 2 is thereby controlled by introducing a phase difference between an electric current flowing in the antenna 2 and an induced electric current flowing in a nearby conductive object 12. The input impedance of the antenna may thus be brought to or closer to the ideal of 50Ω.

Although embodiments of the present invention have been described in the preceding paragraphs with reference to various examples, it should be appreciated that modifications to the examples given can be made without departing from the scope of the invention as claimed. For example, although the antenna 2 has been described as an antenna for cellular radio communication above it may, in other embodiments be used in bands such as: AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz).

Features described in the preceding description may be used in combinations other than the combinations explicitly described.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a conductive antenna;

a conductive object;

a connection having a complex electrical impedance between the conductive antenna and the conductive object; and an element having a complex magnetic permeability located adjacent the conductive antenna, wherein, when the conductive antenna is energized, the connection and the element substantially reduce a phase difference between an electric current flowing in the conductive antenna and an induced electric current flowing in the conductive object.

2. The apparatus as claimed in claim 1, wherein the conductive antenna comprises at least two distinct parts connected to a common feed.

3. The apparatus as claimed in claim 2, wherein the parts are portions of a printed wiring board.

4. The apparatus as claimed in claim 1, wherein the conductive object overlies a feed of the conductive antenna.

5. The apparatus as claimed in claim 1, wherein the conductive antenna is a direct fed dipole antenna.

6. The apparatus as claimed in claim 1, wherein the conductive antenna is operational for at least some frequencies within the range 824 to 960 MHz.

7. The apparatus as claimed in claim 1, wherein the conductive object is located adjacent and close to the conductive antenna.

8. The apparatus as claimed in claim 1, wherein the conductive object comprises metal.

9. The apparatus as claimed in claim 1, wherein the conductive object overlies a region of high H-field associated with the conductive antenna.

10. The apparatus as claimed in claim 1, wherein the connection comprises one or more reactive components.

11. The apparatus as claimed in claim 1, wherein the element comprises a sheet of magnetic material.

12. The apparatus as claimed in claim 1, wherein the element has a complex magnetic permeability with a real value and an imaginary value, wherein a ratio of the real value to imaginary value exceeds five.

13. The apparatus as claimed in claim 1, wherein the element has a complex magnetic relative permeability with a real value and an imaginary value, wherein the real value exceeds twenty.

14. The apparatus as claimed in claim 1, wherein the conductive antenna is located between the element and the conductive object.

15. The apparatus as claimed in claim 1, wherein the magnetic material is located between the conductive antenna and the conductive object.

16. The apparatus as claimed in claim 1, wherein the magnetic material comprises iron.

17. The apparatus as claimed in claim 1, wherein the magnetic material comprises a stack of sub-micron thick iron films.

18. A hand-portable communications device, comprising the apparatus of claim 1.

19. An apparatus comprising:

a conductive antenna having a feed;

a conductive object;

a connection having a reactance between the conductive antenna and the conductive object; and magnetic material located adjacent the conductive antenna, wherein, when the conductive antenna is energized, the connection and the magnetic material substantially reduce a phase difference between an electric current flowing in the conductive antenna and an induced electric current flowing in the conductive object.

20. The apparatus as claimed in claim 19, wherein the conductive antenna comprises at least two distinct parts connected to a common feed.

21. The apparatus as claimed in claim 19, wherein the conductive object overlies a feed of the conductive antenna.

22. The apparatus as claimed in claim 19, wherein the element comprises a sheet of magnetic material.

23. The apparatus as claimed in claim 19, wherein the element has a complex magnetic permeability with a real value and an imaginary value, wherein a ratio of the real value to imaginary value exceeds five.

24. The apparatus as claimed in claim 19, wherein the element has a complex magnetic relative permeability with a real value and an imaginary value, wherein the real value exceeds twenty.

25. The apparatus as claimed in claim 19, wherein the conductive antenna is located between the element and the conductive object.

26. The apparatus as claimed in claim 19, wherein the magnetic material is located between the conductive antenna and the conductive object.

27. A method comprising:

controlling the input impedance of a conductive antenna by:

introducing a phase difference between an electric current flowing in the conductive antenna and an induced electric current flowing in a nearby conductive object;

connecting a complex electrical impedance between the conductive antenna and the nearby conductive object by a connection; and locating an element having a complex magnetic permeability adjacent the conductive antenna, wherein the conductive antenna and the conductive object are connected by the connection, and wherein the phase difference is caused by the connection and the element having a complex magnetic permeability.

28. A method comprising:

controlling the input impedance of a conductive antenna by:

connecting a complex electrical impedance between the conductive antenna and a nearby conductive object by a connection; and locating an element having a complex magnetic impedance located adjacent the conductive antenna, wherein, when the conductive antenna is energized, the connection and the element substantially reduce a phase difference between an electric current flowing in the conductive antenna and an induced electric current flowing in the conductive object.

29. A method as claimed in claim 28, further comprising:

adjusting the complex electrical impedance to control a the phase difference between the electric current in the conductive antenna and the induced electric current flowing in the nearby conductive object.

30. An apparatus comprising:

a conductive antenna;

a conductive object;

means for providing for a complex electrical impedance between the conductive antenna and the conductive object; and means for increasing magnetic permeability adjacent the antenna, wherein, when the conductive antenna is energized, said means for providing for the complex electrical impedance and said means for increasing magnetic permeability reduce a phase difference between an electric current flowing in the conductive antenna and an induced electric current flowing in the conductive object.

31. The apparatus as claimed in claim 30, wherein the means for providing for the complex electrical impedance is adjusted to control the complex electrical impedance.

* * * * *